United States Patent [19]

Berry et al.

[11] 4,288,138

[45] Sep. 8, 1981

[54] FUSE PULLER

[75] Inventors: Edgar L. Berry; Joseph C. Drilling, both of Lexington, Ky.

[73] Assignee: Square D Company, Palatine, Ill.

[21] Appl. No.: 89,001

[22] Filed: Oct. 29, 1979

[51] Int. Cl.[3] ..... H01R 13/633

[52] U.S. Cl. ..... 339/45 R; 337/194; 339/147 R; 339/150 F

[58] Field of Search ..... 339/147, 150 F, 219 F, 339/252 F, 253 F, 256 F, 258 F, 259 F, 262 F, 265 F, 270 F, 45 R; 337/194, 196, 211, 217

[56] References Cited

U.S. PATENT DOCUMENTS 2,526,201 10/1950 Daly ..... 339/219 F 3,418,615 12/1968 Canney ..... 337/194

3,518,599 6/1970 Lanux ..... 337/211

FOREIGN PATENT DOCUMENTS 1535693 7/1968 France ..... 337/211

1259497 1/1972 United Kingdom ..... 339/147 P

*Primary Examiner*—John McQuade

*Attorney, Agent, or Firm*—Larry I. Golden; Norton Lesser; Richard T. Guttman

[57] ABSTRACT

The following specification describes an integrally formed fuse puller assembled for limited movement to a fusible switch base in encircling relationship to a fuse mounted on the base for disengaging the fuse from a fuse clip.

15 Claims, 5 Drawing Figures

FUSE PULLER

BACKGROUND OF THE INVENTION

1. Field of the Invention

This invention relates in general to a fuse puller for a fusible switch and more particularly to a fuse puller and a fusible switch assembly.

2. Summary of the Prior Art

Fusible switches usually incorporate an insulating base carrying an incoming line terminal for each phase of a multiphase circuit with a switch blade for each phase operable to extend a respective circuit from the line terminal through a fuse clip having a fuse seated therein. The fuse is usually secured at both ends to a respective fuse clip each formed by a pair of spring jaws and requires some force usually between 20 and 40 pounds depending on the fuse and clip size for removal.

When it is desired to change or inspect a fuse, the usual practice is to open the switch blades by means of a handle to permit access to the enclosure in which the assembly is located, and then manually extract the fuse from between the clips. Manual extraction is often accomplished by using a screwdriver or the like to lever the fuse loose and can result in breakage since space for fully grasping the fuses to exert the required force is limited. This practice is further subject to criticism since there is a possibility of contacting a live or electrically energized part of the apparatus.

SUMMARY OF THE INVENTION

To enable the required fuse removal force to be exerted without the use of a prying tool, the present invention incorporates an integrally formed fuse puller positioned in the insulating base of a fusible switch. The fuse puller comprises a simple plastic loop member encircling one end of a fuse with a handle portion spaced from the parts and from the line of fuse movement so that it may be easily grasped and on moving the puller in one direction, a strut on the puller disengages the fuse terminal from the fuse clip.

A pair of detents on another strut of the loop serve as one stop cooperating with a stop on the switch base to prevent disengagement of the fuse puller from the base on movement of the puller in one direction to disengage the fuse from the clips. The walls or legs of the puller also cooperate with the walls of the base to guide the movement of the puller while another stop on the base cooperates with a second stop on the puller to limit movement in the opposite direction. Thus the movement of puller is limited in each direction and it may be shipped and used in assembled condition with the base.

It is therefore one object of the present invention to provide a fuse puller for use with a fusible switch.

It is another object of the present invention to provide an improved fusible switch and fuse puller assembly.

Other objects and features of the present invention will become apparent on examination of the following specification drawings and together with the claims.

DESCRIPTION OF THE PREFERRED EMBODIMENT

Figure 1:
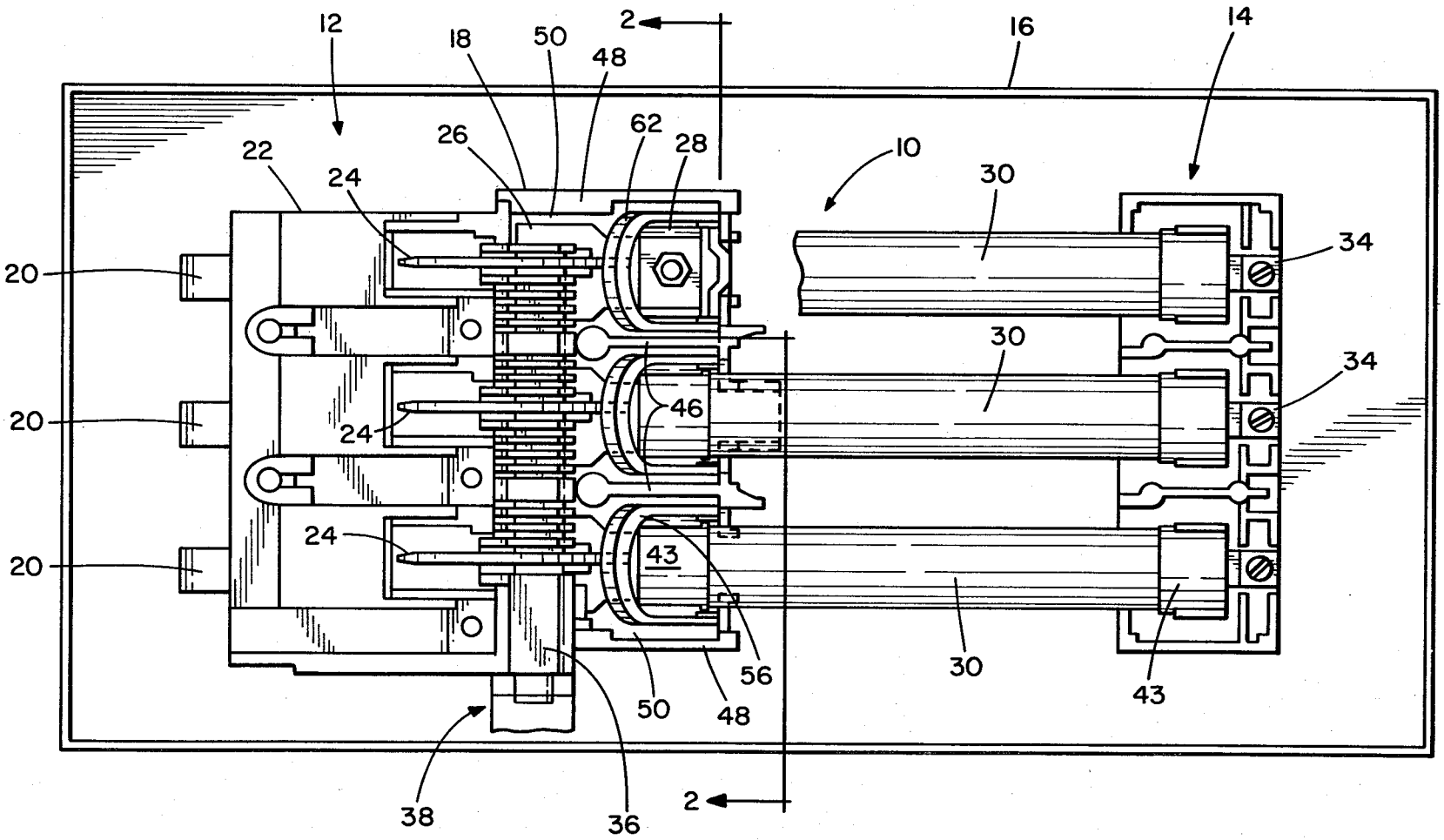
FIG. 1 is a top plan view of a relevant portion of a fusible switch assembly having a fuse puller incorporating the principles of the present invention.

In FIG. 1 a fusible switch assembly for a multiphase circuit is indicated by the reference character 10. The switch assembly comprises a line base assembly 12 and a load base assembly 14 mounted a selected distance apart on a wall of an enclosure 16.

The line base assembly includes an insulating base 18 carrying a plurality of spaced apart line terminals 20 adjacent one end of the base and adapted to be connected to a respective phase of an incoming 30, 60 or 100 amp. multiphase circuit in any well known manner. The terminals 20 each connect to a respective switch contact formed by a pair of spring jaws shown in Ser. No. 089,002 filed Oct. 29, 1979 by Cox, Reed and Drilling and overlapped by an arc suppressor housing 22.

Figure 2:
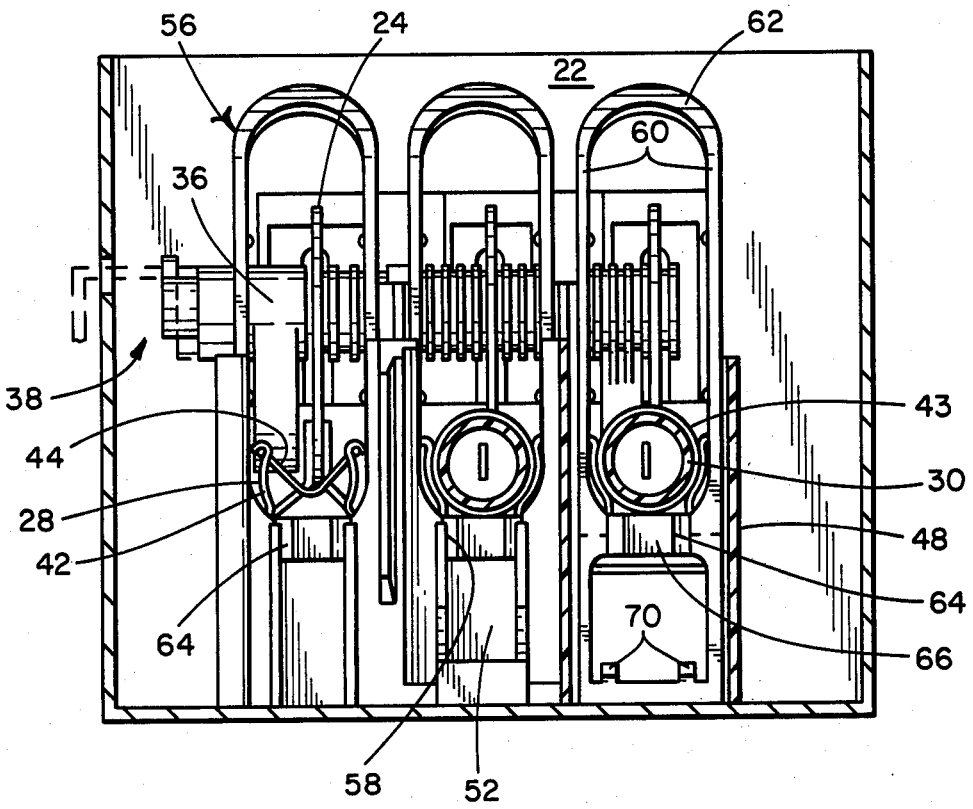
FIG. 2 is a sectional view taken through the line 2—2 in FIG. 1.
Figure 3:
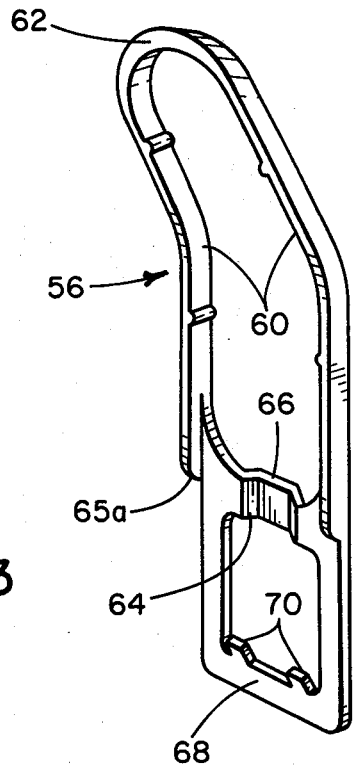
FIG. 3 is an isometric view taken of the fuse puller incorporating the principles of the present invention.
Figure 5:
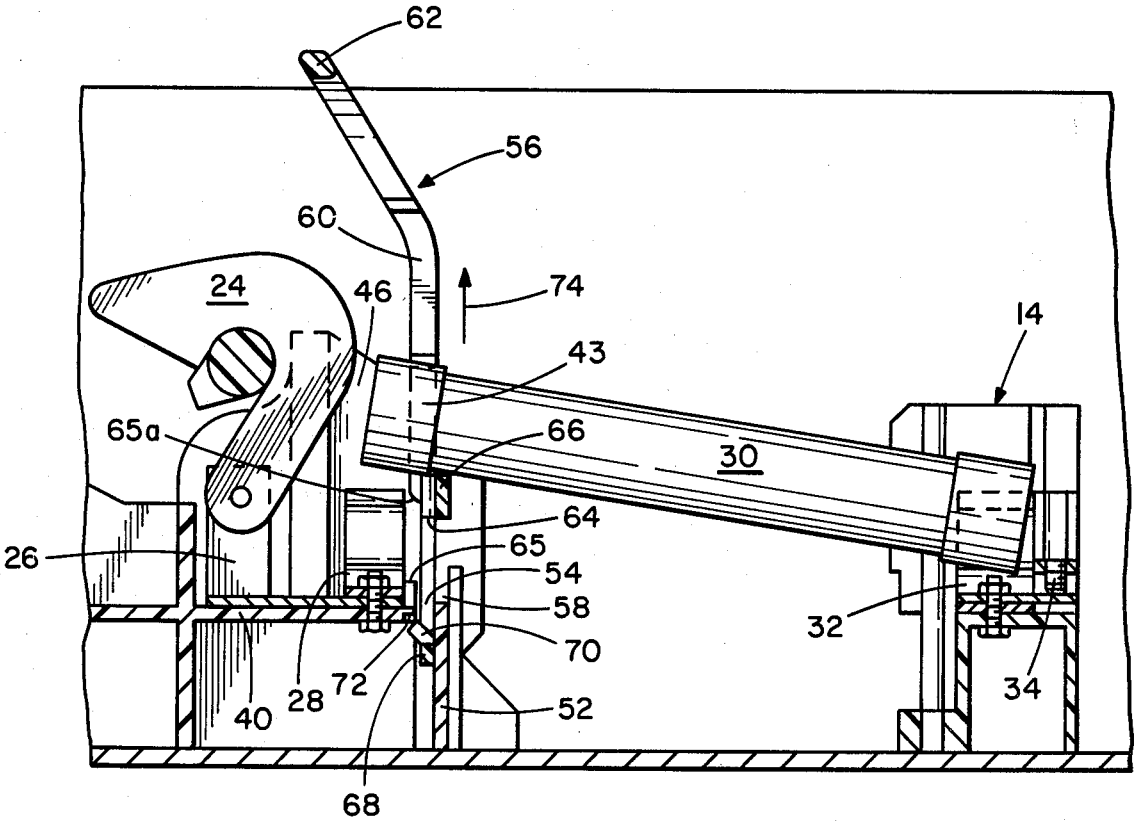
FIG. 5 illustrates the fuse puller in an operated position disengaging a fuse from a fuse clip.

Each switch contact is adapted to be engaged by a respective switch or knife blade 24 received between a respective pair of jaws and extending a respective connection from a respective terminal 20 through the respective blade 24 and a respective terminal 26 to a respective fuse clip 28 secured to switch blade terminal 26 as best seen from FIGS. 2, 5 and 6.

A respective cylindrically shaped fuse 30 extends the electrical connection from a respective clip 28 to a clip 32 mounted on an insulating base of the load base 14. From the load base clip 32, a connection may be established to a load by means of a respective lug terminal 34. It will be appreciated that the insulating bases may be secured directly to the wall of the enclosure.

Figure 4:
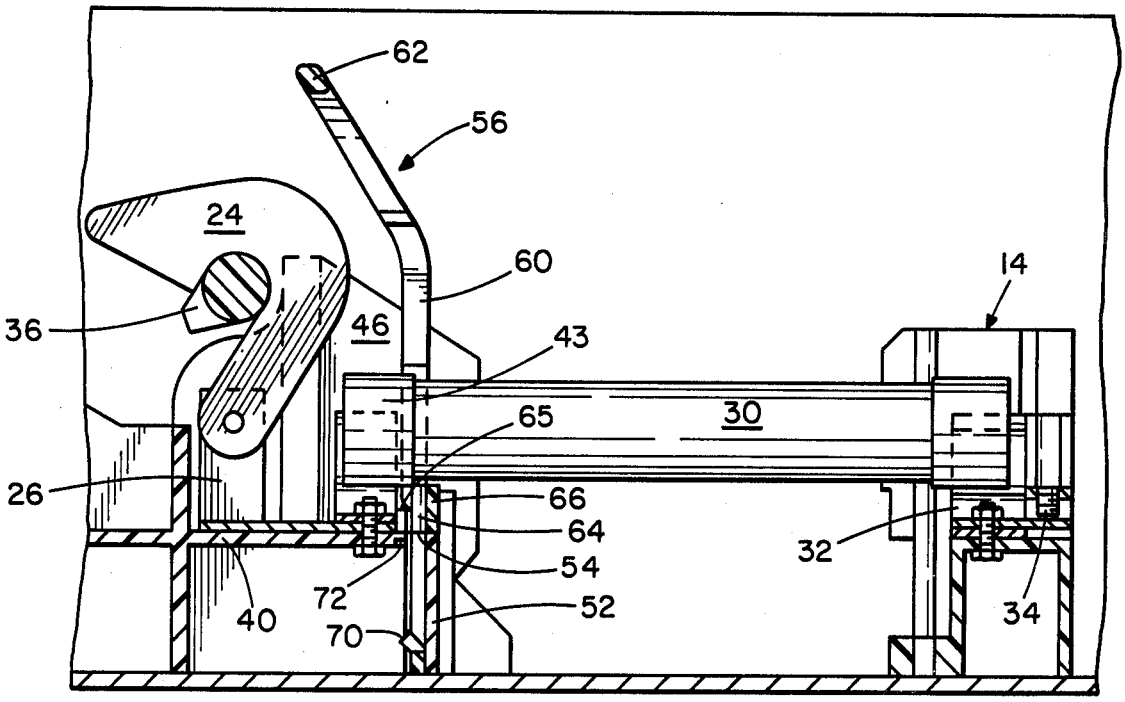
FIG. 4 is a partial sectional view illustrating the fuse puller in the unoperated position.

The knife blades 24 are pivotally supported between arms of a respective terminal 26 for pivoting or rotational movement about a common axis and the knife blades 24 are engaged by a common rotor 36 having a pivot axis coincident with the pivot axis of the blades as explained in the aforementioned application by Cox, Reed and Drilling. The rotor 36 engages the blades at a position offset from the pivot axis and has a non-circular end portion adapted to be engaged with handle assembly 38 extending through a wall of the enclosure. The handle assembly 38 may include a conventional interlock assembly for preventing opening of the enclosure 16 unless the blades are operated to a position spaced from the respective switch contact as seen in FIGS. 4 and 5 to open the circuits from the line terminals 20.

The arc suppressor housing 22 includes arc suppression plates and forms an arc suppressing chamber for each blade 24 and the associated switch contacts and is described together with the other components of the line base assembly more fully in the aforementioned application by Cox, Reed and Drilling.

The fuse clips 28 together with the terminals 26 are securely mounted on a platform wall 40 of the insulating base 18 in alignment with a respective clip 32. Each clip comprises a pair of cantilever arcuate jaw members 42 adapted to receive a respective circularly shaped ferrule or terminal 43 at a respective end of fuse 30 therebetween. A "V" shaped wire member 44 secured between the upper end of the jaw members 42 of clips 28 prevents overstressing the jaw members and may serve as a fuse rejection device to prevent the insertion of an improperly sized or rated fuse in the fuse clip.

The platform wall 40 has partition or barrier walls 46 projecting upwardly and downwardly from the platform wall between the adjacent terminals 26 and adjacent fuse clips 28 and with side walls 48 of the insulating base define compartments 50 for each phase extending longitudinally on the base 18. The platform wall 40 terminates at a position spaced from an end wall 52 of the base 18 with the fuse clips 28 also spaced from the end wall 52 of the base to define a linear guideway or passage 54 for receiving a fuse puller 56.

The end wall 52 spans walls 46 and 48 below the platform wall 40 and merges with the walls 46 and 48 above wall 40 in an arcuate configuration of greater diameter than the fuse and jaw members 42. A guideway or recess 58 is formed in the arcuate portion along the central axis of each compartment and located just below the bases and the arcuate portion of the jaw members 42.

The fuse puller 56 is integrally formed of a loop of thermoplastic material such as that sold by the General Electric Company under the trade name of Noryl SE100. The puller includes spaced side legs 60 terminating at the upper or one end in a finger loop or handle portion 62. Handle portion 62 is located above the knife blades and fuses for facile access. The legs 60 extend through the guideway 54 and are spaced to straddle the respective fuses 30 with flat outer surfaces on the legs engaging the surfaces of adjacent walls 46 or 48 to guide the puller. The upper ends of legs 60 adjacent handle 60 are bent to extend longitudinally past the adjacent axial end of the fuse in the direction of the knife blades to position the handle portion 62 intermediate the clips 28 and blades 24 for enabling facile removal of a respective fuse 30 without being trapped by handle portion 62.

A fuse lifting strut 64 having an arcuate upper edge conforming to the upper edge of wall 52 is formed on each fuse puller 56 intermediate the ends of the legs 60. A projecting stop portion 66 on each strut 64 seats in the recess 58 and on the lower edge of the recess in end wall 52. Thus the strut 64 as shown in FIG. 4 normally seats just below the respective fuse 30 with the portion 66 and the upper edge of wall 52 in the recess 58 acting as stops to limit downward movement of the puller when it is released. In addition a pair of nibs 65 on the platform wall, which seat the leading edge of a respective fuse clip 28, also serve as stops for the downward movement of the fuse puller by engagement with a stopped or offset portion 65*a* on each leg of the puller.

The legs 60 extend below the strut 64 to a flat surfaced second or lower strut 68 spaced from strut 64 and guiding on wall 52. Strut 68 is located at a position generally coincident with the lower edge of the end wall 52. A pair of spaced apart detents 70 are formed on the lower strut 68.

Detents 70 are adapted to engage with the lower surface of a recessed lip 72 formed at the edge of the platform wall 40 beneath nibs 65 and adjacent passage 54 to act as stops when the puller 56 is raised to disengage a fuse from a respective clip. The detents 70 project in the direction of wall 40 so that they may flex toward the opening between struts 64 and 68 for enabling the strut 68 to be positioned between walls 40 and 52 so that the detents 70 can be inserted past lip 72 and the puller assembled to the base, but when the puller is raised, the detents 70 are trapped between the lip 72 and the wall 40 to compress the same toward strut 68 and prevent disengagement of the fuse puller from the base.

Before operation of the puller 56 the handle assembly 38 is conventionally operated to disengage the knife blades 24 from their respective spring jaws and disconnect power from the fuses 30 whereafter the enclosure 16 may be opened. One of the fuse pullers 56 may then be grasped by inserting a finger beneath the handle portion 62 and the puller 56 moved in one direction indicated by arrow 74 in FIG. 5. This movement engages strut 64 with the lower surface portion of the terminal 43 and the insulating envelope extending between the terminals of the respective fuse 30 to disengage terminal 43 of the fuse from the respective fuse clip 28 as shown in FIG. 5. The fuse is canted by this movement to also spread the spring jaws of the load block fuse clip 32 to also permit the facile removal of the fuse therefrom. Movement of the puller 56 is stopped when detents 70 engage the lip 72 of the platform wall. The puller may now be released to engage stop 66 with end wall 52 and the offset walls portions with a respective nib 65. The fuse may then simply rest on the upper edge of clip 28 and may thereafter be easily lifted past the handle portion 62, which is located behind or offset from the axial end of the fuse.

To replace a fuse, the puller 56 is simply left in the position shown in FIG. 4 and a respective end of the fuse inserted between the fuse puller legs 60 to align the fuse terminals 43 with the clips 28 and 32 on the line and load bases. Pressure applied to the respective fuse ends then snaps the fuse terminals 43 between the jaws of the respective clips 28 and 32 to seat the fuse whereafter the enclosure 16 may be closed and the handle assembly 38 operated to engage the knife blades 24 with their respective jaw members.

The foregoing is a description of a fuse puller and fusible switch assembly incorporating the fuse puller whose inventive concepts are believed set forth in the accompanying claims.

What we claim is:

1. A fusible switch assembly having a fuse puller for disengaging a fuse extending between a pair of spaced fuse clips secured to an insulating assembly, the improvement comprising:

said insulating assembly having portions defining a linear guideway adjacent one of said clips, said guideway extending transverse to the axis of said fuse and positioned intermediate the ends of said fuse and between said clips, an integrally formed loop of insulating material encircling the axis of said fuse and having a handle portion adapted to be manually engaged and a second portion engaged in said guideway to guide the movement of said loop transverse to said axis, a first wall portion integrally formed on said loop intermediate the ends of said loop for engaging said fuse to disengage said fuse from one of said clips in response to manual engagement of said handle portion and movement of said loop along said guideway in one direction, and stop means integrally formed on said loop for engaging respective portions of said insulating assembly to define respective limit positions in the movement of said loop in said one direction and in a second direction opposite said one direction.

2. The assembly claimed in claim 1 in which said handle portion is offset past one end of said fuse to enable movement of said fuse past said handle portion.

3. The assembly claimed in claim 1 in which said loop comprises an elongate pair of spaced legs straddling said fuse and connected at opposite ends, said handle portion inclined toward said one clip to enable movement of said fuse past said handle portion.

4. The assembly claimed in claim 3 in which said legs each have a flat surface portion for guiding engagement with a respective flat surface portion of said insulating assembly.

5. The assembly claimed in claim 4 in which said stop means comprises an offset wall on said first wall portion intermediate the ends of said legs to engage said insulating assembly in response to movement of said handle portion in a said second direction.

6. The assembly claimed in claim 5 in which said stop means comprises a second wall portion integrally formed on said legs and spaced from said first wall portion, and a pair of detents integrally formed on said second wall portion for engaging said insulating assembly in response to movement in said one direction.

7. The assembly claimed in claim 6 in which each clip comprises a pair of spring jaws and said fuse is disengaged from between one pair of jaws in response to said movement in said one direction and displaces the jaws of the other clip.

8. A assembly as claimed in claim 6 in which said insulating assembly comprises an insulating base for a fusible switch having a platform wall and a transverse end wall spaced from said platform wall to receive said legs therebetween with said offset wall engaging said end wall in response to movement of said loop in said second direction and said detents engaging said platform wall in response to movement of said loop in said one direction.

9. A fusible switch and fuse puller assembly comprising:

an insulating base having a platform wall to which a first fuse clip is secured with said clip having a pair of spring jaws engaging one terminal of a fuse extending to another fuse clip, said base having depending flat surface walls and an end wall spaced from said platform wall to define a linear guideway transverse and adjacent to said platform wall, said end wall overlapped by said fuse, a switch carried by said platform wall for extending a circuit to said first fuse clip and fuse and located adjacent one end of said first clip and fuse, an integrally formed loop of insulating material having one portion offset outward and displaced from said switch and fuse for manual engagement, said loop having opposite leg portions straddling said fuse and positioned within said guideway intermediate opposite longitudinal ends of said fuse, a wall portion integrally formed between said leg portions intermediate the ends of said leg portions and adjacent said platform wall for engaging said fuse to disengage said fuse from the spring jaws of said first clip in response to manual engagement of said one portion and movement of said loop along said guideway in one direction, and stop means on said wall portion and leg portions for engaging respective portions of said base to define respective limit positions in opposing movements of said loop along said guideway.

10. The assembly claimed in claim 9 in which each of said leg portions engages a respective depending wall to guide the movement of said loop.

11. The assembly claimed in claim 9 in which said stop means comprises an offset wall section on said wall portion for engaging said end wall in response to movement in an opposite direction from said one direction.

12. The assembly claimed in claim 9 in which said stop means comprises a detent integrally formed on said leg portions and engaging said platform wall in response to movement of said legs a predetermined distance in said one direction.

13. The assembly claimed in claim 12 in which said detent is adapted to flex in one flexing direction in response to movement of said legs in said one direction for enabling said detent to pass between said end wall and platform wall.

14. The assembly claimed in claim 13 in which said platform wall has a portion of recessed section forming one edge of said guideway for capturing said detent and for compressing said detent in a direction opposite said one flexing direction to prevent movement of said detent through said guideway.

15. The assembly claimed in claim 9 in which said stop means comprises a pair of nibs on said platform wall for each clip to locate one edge of the respective clip and an offset wall portion on each leg portion intermediate the leg portion ends for engaging a respective nib to terminate movement of said legs in a direction opposite said one direction.

* * * * *